US012638190B2

(12) United States Patent
Shin

(10) Patent No.: US 12,638,190 B2
(45) Date of Patent: May 26, 2026

(54) ELECTRONIC COOKING APPARATUS HAVING STEAM SUPPLY DEVICE

(71) Applicant: LG ELECTRONICS INC., Seoul (KR)

(72) Inventor: Seungjun Shin, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 1185 days.

(21) Appl. No.: 17/287,210

(22) PCT Filed: Oct. 22, 2019

(86) PCT No.: PCT/KR2019/013907
§ 371 (c)(1),
(2) Date: Oct. 29, 2021

(87) PCT Pub. No.: WO2020/085771
PCT Pub. Date: Apr. 30, 2020

(65) Prior Publication Data

US 2022/0057087 A1 Feb. 24, 2022

(30) Foreign Application Priority Data

Oct. 23, 2018 (KR) ..... 10-2018-0126741

(51) Int. Cl.
*F24C 15/32* (2006.01)
*F22B 1/28* (2006.01)
(Continued)

(52) U.S. Cl.
CPC ..... *F24C 15/327* (2013.01); *F24C 7/085* (2013.01); *F24C 15/003* (2013.01);
(Continued)

(58) Field of Classification Search
CPC ..... F24C 15/327; F24C 7/085; F24C 15/003; F24C 15/2007; F22B 1/282; F22B 37/78; F22B 1/285; F22D 5/32; F22D 5/26
(Continued)

(56) References Cited

U.S. PATENT DOCUMENTS

2007/0186593 A1* 8/2007 Ahn ..... F22B 1/28 68/5 R
2009/0038481 A1 2/2009 Yamamoto et al.
(Continued)

FOREIGN PATENT DOCUMENTS

EP 2369227 A2 * 9/2011 ..... F22B 1/28
JP 02-197702 8/1990
(Continued)

OTHER PUBLICATIONS

Korean Notice of Allowance dated May 26, 2022.
(Continued)

*Primary Examiner* — Topaz L. Elliott
*Assistant Examiner* — Daniel Ward Hatten
(74) *Attorney, Agent, or Firm* — KED & ASSOCIATES

(57) ABSTRACT

An electronic cooking apparatus having a steam supply device for supplying steam to a cooking chamber of an oven is provided. The electronic cooking apparatus may include a steam generating device including a steam supply portion that generates steam and supplies the steam to a cooking chamber, and a water level sensing module that senses a level of water inside of the steam supply portion using a low water level sensor and a high water level sensor. In addition, the electronic cooking apparatus may include a water supply pump that supplies water from a water tank to the steam supply portion; a drain pump that collects condensed water from the steam supply portion to the water tank; and a controller that controls on/off operations of the water supply
(Continued)

pump or the drain pump according to a change in the level of water in the steam supply portion sensed by the water level sensing module.

20 Claims, 12 Drawing Sheets

(51) Int. Cl.

| | |
|---|---|
| ***F22B 37/78*** | (2006.01) |
| ***F24C 7/08*** | (2006.01) |
| ***F24C 15/00*** | (2006.01) |
| ***F24C 15/20*** | (2006.01) |
| *F22D 5/32* | (2006.01) |

(52) U.S. Cl.
CPC ..... *F24C 15/2007* (2013.01); *F22B 1/282* (2013.01); *F22B 37/78* (2013.01); *F22D 5/32* (2013.01)

(58) Field of Classification Search
USPC ..... 219/401
See application file for complete search history.

(56) References Cited

U.S. PATENT DOCUMENTS

| | | | | |
|---|---|---|---|---|
| 2011/0100477 | A1 | 5/2011 | Miller | |
| 2012/0107460 | A1* | 5/2012 | Lubrina | F24C 7/08 426/231 |
| 2012/0199015 | A1* | 8/2012 | Seguchi | A47J 27/04 99/403 |
| 2014/0251159 | A1* | 9/2014 | Yang | A21B 3/04 99/341 |
| 2015/0323132 | A1* | 11/2015 | Lee | F01K 5/02 137/183 |
| 2016/0273778 | A1* | 9/2016 | Son | F24C 15/2007 |
| 2016/0360916 | A1 | 12/2016 | Utsumi et al. | |
| 2017/0164778 | A1* | 6/2017 | Utsumi | F22B 1/285 |
| 2018/0070757 | A1 | 3/2018 | Lee et al. | |
| 2018/0098389 | A1 | 4/2018 | Kamiya et al. | |
| 2018/0299138 | A1* | 10/2018 | Faraldi | F24C 15/2007 |
| 2018/0332993 | A1* | 11/2018 | Cho | A47J 36/00 |
| 2019/0203944 | A1 | 7/2019 | Cho et al. | |
| 2019/0309957 | A1* | 10/2019 | Buschman | F24C 15/32 |
| 2019/0387913 | A1 | 12/2019 | Lee et al. | |

FOREIGN PATENT DOCUMENTS

| | | |
|---|---|---|
| KR | 10-2008-0031994 | 4/2008 |
| KR | 10-2008-0065134 | 7/2008 |
| KR | 10-2010-0111205 | 10/2010 |
| KR | 10-1480462 | 1/2015 |
| KR | 10-2018-0028642 | 3/2018 |
| KR | 10-2018-0028643 | 3/2018 |
| KR | 10-1876117 | 7/2018 |
| WO | WO 2018/048119 | 3/2018 |

OTHER PUBLICATIONS

European Search Report issued in Application No. 19874997.0 dated Jul. 17, 2022.
International Search Report (with English Translation) dated Feb. 7, 2020 issued in Application No. PCT/KR2019/013907.
Korean Notice of Allowance dated Mar. 17, 2020.

* cited by examiner

ELECTRONIC COOKING APPARATUS HAVING STEAM SUPPLY DEVICE

CROSS-REFERENCE TO RELATED APPLICATION

This application is a U.S. National Stage Application under 35 U.S.C. § 371 of PCT Application No. PCT/KR2019/013907, filed on Oct. 22, 2019, which claims priority to Korean Patent Application No. 10-2018-0126741, filed on Oct. 23, 2018, whose entire disclosures are hereby incorporated by reference.

BACKGROUND

1. Field

An electronic cooking apparatus including a steam supply device is disclosed herein.

2. Background

An electronic cooking apparatus including an oven is a home appliance to cook food using heat. Recently, an electronic cooking apparatus including a steam supply device has been released to enhance a texture of food and minimize destruction of nutrients contained in the food by spraying steam into a cooking portion.

A shape of a steam generator, a steam supply pattern according to a location of the steam generator, and an operation of supplying water for steam generation and steam supply are very important factors to maximize steam generation efficiency of the steam supply device.

To accurately use these important factors, the steam supply device includes a water tank configured to supply water to the steam generator to generate steam and a connection pipe configured to transfer water in the water tank to the steam generator. In addition, the steam generator includes a water storage portion configured to store the water supplied from the water tank and a steam heater configured to generate steam by heating the water in the water storage portion.

For the above-described electronic cooking apparatus including the steam supply device such as an oven, the water is injected into the water tank and flows into the water storage portion through the connection pipe, and the water introduced into the water storage portion is heated by the steam heater to generate the steam. The steam generated as described above is introduced into the cooking portion and circulates through an inside of the cooking portion. In this manner, food items are cooked using the steam.

As the steam supply device needs to supply the steam to the cooking portion while the food items are cooked, it is very important to smoothly supply the water from the water tank based on a water level in the water storage portion. However, in the related art, there was no method of accurately detecting the water level in the water storage portion or determining smooth water supply or non-smooth water supply from the water tank. For this reason, there has been a problem in that the food items are cooked even when steam is not properly generated, or water is not supplied.

In particular, if steam is not generated and is not supplied at a correct timing while the food items are cooked, problems such as drying of the food or evaporation of taste and flavor occur, thereby degrading users satisfaction and user reliability.

DISCLOSURE

Technical Problem

Embodiments disclosed herein provide an electronic cooking apparatus including a steam supply device capable of improving a water level detection function by generating steam and supplying the steam into a cooking portion and maximizing steam generating efficiency and cooking efficiency by performing the water level detection function thereof.

Technical Solution

An electronic cooking apparatus including a steam supply device according to an embodiment includes a steam generating device including a steam supply portion configured to generate steam and supply the steam to a cooking portion and a water level sensing module configured to detect a water level of an inside of the steam supply portion using a low water level sensor and a high water level sensor. In addition, the electronic cooking apparatus includes a water supply pump configured to supply water from a water tank to the steam supply portion, a drain pump configured to recover condensed water from the steam supply portion to the water tank, and a control unit (controller) configured to control on/off operations of the water supply pump or the drain pump according to changes in water level of the steam supply portion detected by the water level sensing module.

The control unit is configured to: if the water level inside of the steam supply portion detected by the low water level sensor is maintained at a low water level for a preset or predetermined period of time, drive the water supply pump for the preset time period or until a high water level is detected by the high water level sensor and if the water level inside of the steam supply portion detected by the high water level sensor is maintained at the high water level for the preset time period, drive the drain pump for the preset time period or until the high water level is not detected by the high water level sensor. In addition, the control unit is configured to detect a switch signal of the water tank in real time and indicate a mounted state or a removed state of the water tank on a display panel or through an alarm generating speaker, and if steam-cooking is not set and oven-cooking is only set even when the water tank is removed, stop the operation of the steam supply portion and operate at least one cooking heater, a convection fan, and a ventilation fan to oven-cook food items.

Advantageous Effects

According to an embodiments disclosed herein, an electronic cooking apparatus includes a steam supply device may improve a water level detection function of the steam supply device. In this case, the electronic cooking apparatus including the steam supply device has an effect of maximizing steam generating efficiency and cooking efficiency by performing the water level detection function.

In particular, an electrode-type high water level sensor and an electrode-type low water level sensor having high temperature resistance are disposed in a condensed water storage portion of the steam supply device to detect quantity needed to generate steam in real time. In addition, water from the water tank may be supplied to the steam generator by controlling a water supply pump in real time to satisfy the quantity needed to generate steam. In addition, a water level state of the condensed water storage portion and a mounted state or a separated state of the water tank may be indicated using a display panel or by a sound alarm. Therefore, there is an effect of improving user satisfaction and user reliability for the electronic cooking apparatus including the steam supply device.

DETAILED DESCRIPTION

Figure 1:
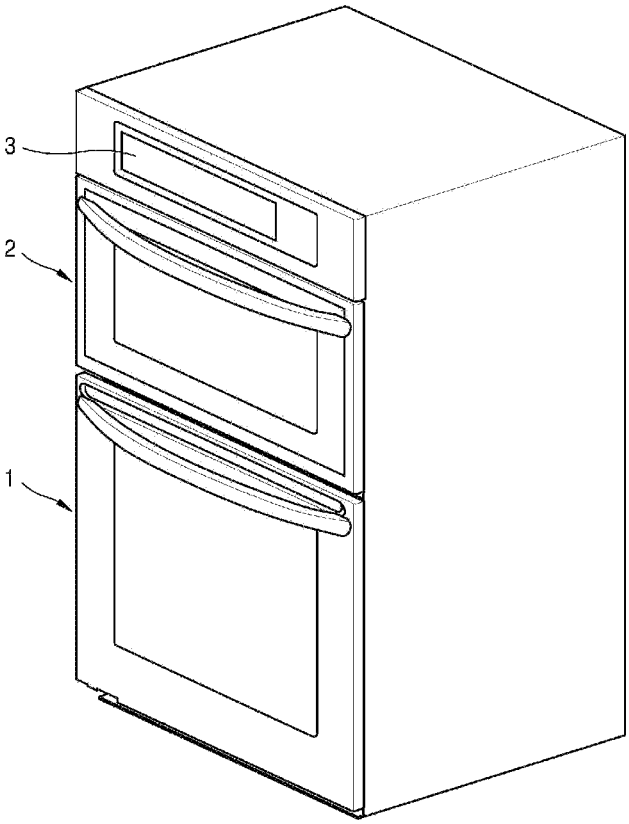
FIG. 1 is a perspective view of an electronic cooking apparatus including a steam supply device according to an embodiment.

Embodiments are described hereinafter with reference to accompanying drawings. Therefore, a person having ordinary knowledge in the art to which the embodiments pertain may easily implement the technical idea. Description of well-known technology relating to the embodiments may be omitted if it unnecessarily obscures the gist. In the drawings, same reference numerals may be used to refer to the same or similar components.

Figure 2:
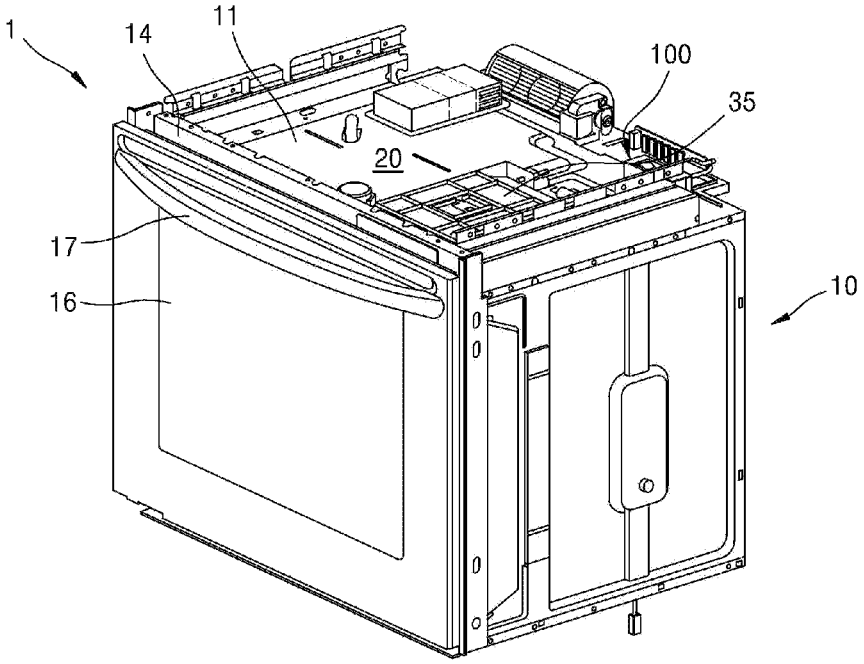
FIG. 2 is a perspective view showing a portion of the electronic cooking apparatus in FIG. 1.
Figure 3:
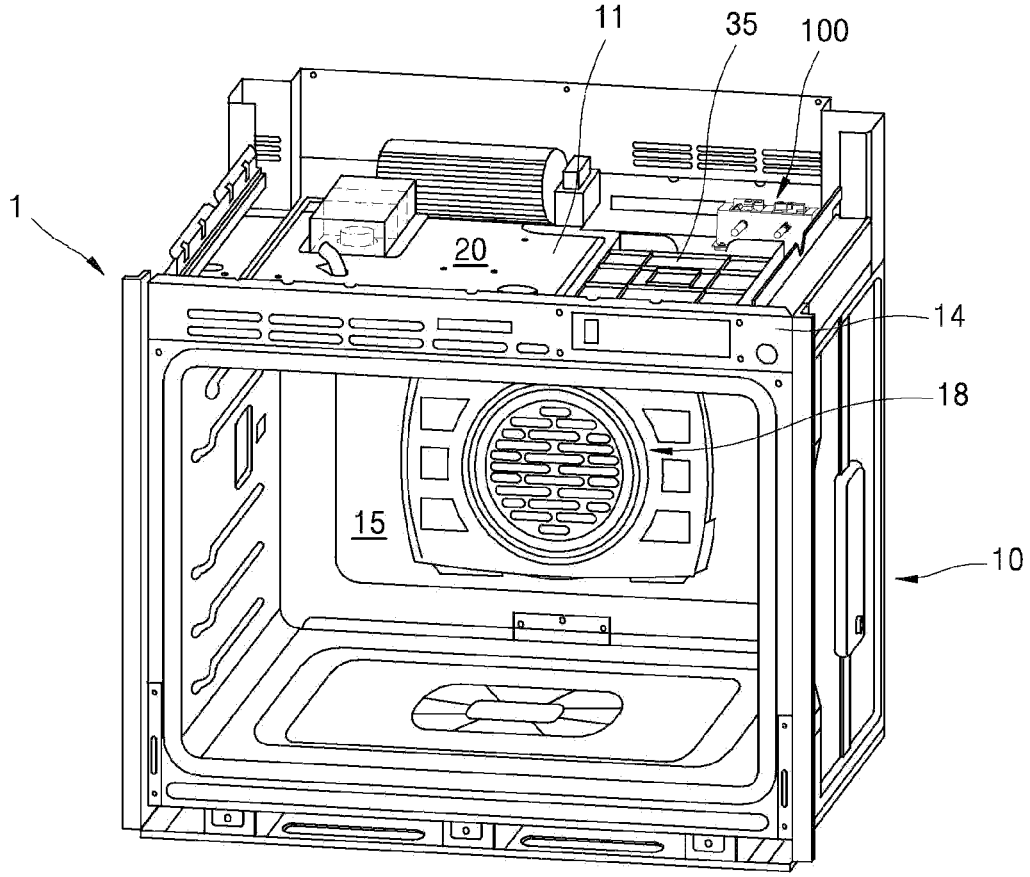
FIG. 3 is a perspective view showing the electronic cooking apparatus in FIG. 2, from which a door is removed.

FIG. 1 is a perspective view of an electronic cooking apparatus including a steam supply device according to an embodiment. FIG. 2 is a perspective view showing a portion of the electronic cooking apparatus in FIG. 1. In addition, FIG. 3 is a perspective view showing the electronic cooking apparatus in FIG. 2, from which a door is removed.

Referring to FIG. 1, the electronic cooking apparatus according to an embodiment may include a first unit 1 disposed at a lower portion thereof, a second unit 2 disposed at an upper portion thereof, and a control unit (controller) 3. Both the first unit 1 and the second unit 2 are closed cooking apparatuses, such as electric ovens; however, embodiments are not limited thereto. For example, a cooking apparatus may include the first unit 1 disposed at a lower portion thereof, which is an electric oven, and the second unit 2 disposed at an upper portion thereof, which is a gas oven. As another example, a closed type cooking apparatus other than the oven, such as a microwave, may be used as the second unit 2, and an open type cooking apparatus, such as a cooktop, a hop, and a griddle, for example, may be used as the second unit 2 and may be disposed on the first unit 1.

The control unit 3 includes at least one display panel, a sound speaker, a plurality of operation switches, and a control board including a microprocessor unit (MPU), for example. The control unit 3 controls a cooking operation of the first and second units 1 and 2 according to user's control command input to a plurality of operation switches and also controls a steam generation operation of the steam supply device. Technical features of the specific cooking operation control and the steam generation control by the control unit 3 are described in detail below with reference to the accompanying drawings.

Hereinafter, a configuration of the cooking apparatus including the first unit 1 and the second unit 2, which are electric ovens, is described, and is described with respect to the configuration of the first unit 1. Referring to FIGS. 2 and 3, the first unit 1 includes a main body 10 defining an outer appearance. The main body 10 may have a substantially rectangular parallelepiped shape and is made of material having a preset or predetermined strength to protect a plurality of components disposed in an inner space thereof.

The main body 10 may include a cavity 11 forming a skeleton of the main body 10 and a front plate 14 disposed in front of the cavity 11 to form a front surface of the main body 10. A cooking portion (chamber) 15 is defined inside of the cavity 11, and an opening to open the cooking portion 15 forward is defined inside of the front plate 14.

The cooking portion 15 is disposed inside of the main body 10. The cooking portion 15 has a hexahedron shape defining an opening on a front surface thereof, and when the cooking portion 15 is closed, an inner space of the cooking portion 15 is heated to cook food items. That is, for the electronic cooking apparatus, the inner space of the cooking portion 15 is a space in which food is substantially cooked.

The electronic cooking apparatus includes a plurality of cooking heaters and a convection fan 18 to heat the cooking portion 15. Each cooking heater may heat at least one of an upper portion, a lower portion, a left (first lateral) portion, or a right (second lateral) portion of the inner space of the cooking portion 15. The convection fan 18 entirely heats the inner space of the cooking portion 15 by convecting hot air.

A door 16 is rotatably disposed at a front side of the main body 10 to selectively open and close the cooking portion 15. The door 16 may open and close the cooking portion 15 in a pull-down manner in which an upper end thereof rotates vertically about a lower end thereof.

The door 16 has a hexahedral shape with a preset or predetermined thickness. A handle 17 is disposed on a front surface thereof in order for the user to grip the door 16 when the user wants to rotate the door 16.

An electric space 20 is defined above the main body 10, that is, in a space between the first unit 1 and the second unit 2 stacked thereon to provide a space in which electric components are disposed. A lower boundary surface of the electric space 20 may be defined by an upper surface of the cavity 11 and an upper boundary surface of the electric space 20 may be defined by a lower surface of the second unit 2. In addition, a front surface of the electric space 20 may be closed by the front plate 14.

Figure 4:
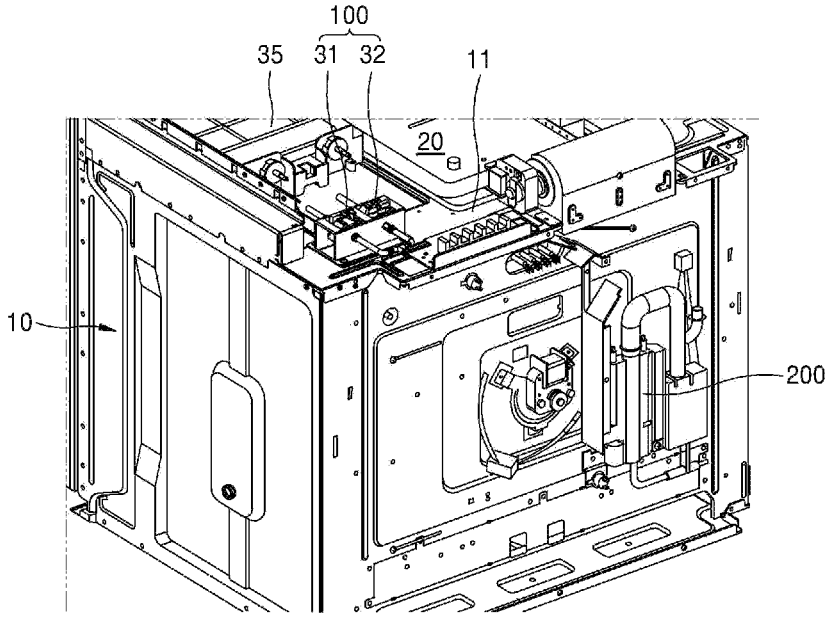
FIG. 4 is a schematic diagram showing a mounting configuration of a steam supply device according to an embodiment.

FIG. 4 is a schematic diagram showing a mounting configuration of a steam supply device according to an embodiment. Referring to FIG. 4 along with FIG. 3, a steam supply device 200 may be disposed on a rear surface of a main body 10. More specifically, the steam supply device 200 may supply steam into the cooking portion 15 from a rear portion of the main body 10, and a water tank 35 may be disposed on the main body 10. The main body 10 may further include a flow path that connects the water tank 35 to the steam supply device 200 and a pump module 100 connected to the flow path.

The water tank 35, which may be a drawer-type water tank, may be disposed at one side of the upper portion of the main body 10, and may be provided detachably from the cavity 11. In addition, the water tank 35 may be inserted into or withdrawn from a tank housing and the tank housing may be coupled to an upper portion of the cavity 11. A water tank switch is disposed on a rear surface of the tank housing to detect a mounted state and a removed state of the water tank 35 in real time and transmits, to the control unit 3, a mounting and removal detection signal of the water tank 35 in real time.

A water supply port and a drain port may each protrude from the rear surface of the tank housing. In addition, a water supply flow path and a drain flow path may each have a bendable tube shape.

The pump module 100 includes a water supply pump 31 to supply water in the water tank 35 to the steam supply device 200 and a drain pump 32 to return water remaining in the steam supply device 200 back to the water tank 35. The drain pump 32 functions to return the water from the steam supply device 200 back to the water tank 35, and thus, may be defined as a recovery pump.

A flow path (not shown) that connects the water tank 35 to the steam supply device 200 may include a water supply flow path connected to a water supply port of the water supply pump 31, a drain flow path connected to a drain port of the drain pump 32, and a common flow path connected to a point at which the water supply flow path and the drain flow path meet. In this case, ends of the water supply flow path and the drain flow path that extend from outlets of the water supply pump 31 and the drain pump 32 meet at one point, and the common flow path (not shown) may extend from the point at which they meet. An outlet end of the common flow path is connected to a water supply inlet and a drain outlet of the steam supply device 200.

Figure 5:
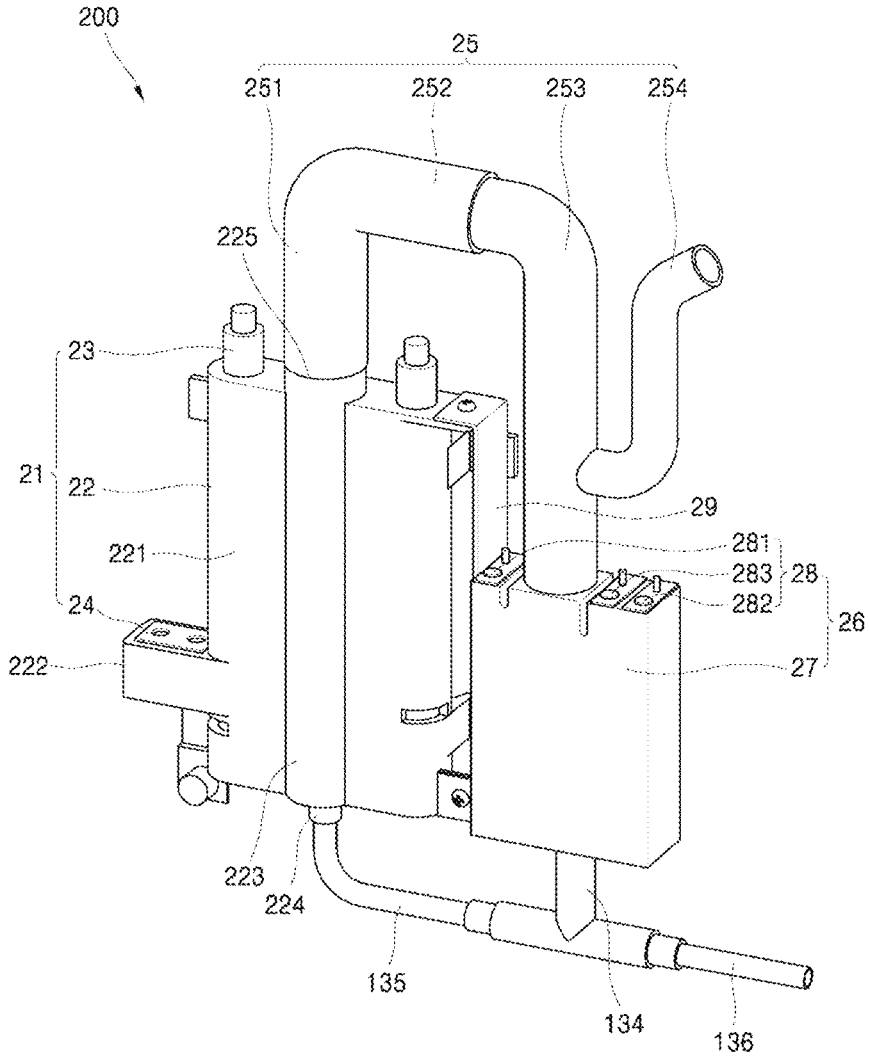
FIG. 5 is a side perspective view of the steam supply device of FIG. 4.

FIG. 5 is a side perspective view of the steam supply device of FIG. 4. As shown in FIG. 5, a water supply flow path 135 is connected to a water supply inlet 224 of steam supply device 200 and a drain flow path 134 is connected to a drain outlet of the steam supply device 200. A common flow path 136 is provided at a point at which the water supply flow path 135 and the drain flow path 134 meet and is integrally connected to the common flow path 136 of the water tank 35.

According to this flow path structure, water filled in water tank 35 is supplied to the common flow path 136 of the steam supply device 200 along the water supply flow path 135 and the common flow path 136 by operation of the water supply pump 31. In addition, the steam supply device 200 receives the water through the common flow path 136 and the water supply flow path 135 to generate steam. The water remaining in the steam supply device 200 after the steam is supplied may be transferred to the common flow path 136 and the water tank 35 through the recovery flow path 134 based on the operation of drain pump 32.

Referring to FIG. 5, a configuration and function of the steam supply device 200 are described hereinafter. Referring to FIG. 5, the steam supply device 200 includes a steam supply portion 21 to generate and supply steam, a steam supply flow path 25 to guide the steam generated by the steam supply portion into cavity 11, and a condensed water storage portion 26 disposed between one end of the supply flow path 25 and the water supply flow path 135 connected to the steam supply portion 21 to store condensed water based on the steam generated by the steam supply portion 21.

More specifically, the steam supply portion 21 may include a cast-type case 22, a steam heater 23 accommodated in the case 22 and to generate steam, a thermistor 24 disposed in the case 22 and to prevent overheating. The condensed water storage portion 26 may be coupled to a side surface of the steam supply portion 21 by a fastening bracket 29.

The case 22 of the steam supply portion 21 includes a heater accommodator 221 having a substantially hexahedral shape, a thermistor mounter 222 that protrudes from one side of the heater accommodator 221 and to mount the thermistor 24, a steam generator 223 that extends in a cylinder shape at a middle portion of the heater accommodator 221, and water supply inlet 224 that extends from a lower end of the heater accommodator 221.

The steam heater 23 may be a U-shaped sheath heater, and both ends of the steam heater 23 may protrude from an upper surface of the case 22, more specifically, the heater accommodator 221. In addition, steam generator 223 may be disposed between the both ends of the steam heater 23. The heater accommodator 221 may have a vertical length which is larger than a horizontal width thereof and may have a thickness which is larger than a diameter of the steam heater 23.

The steam generator 223 may have a hollow cylindrical shape to fill steam and water. A rear end of the steam generator 223 may be spaced apart from a rear end of the heater accommodator 221.

In addition, as shown, an inner diameter of the steam generator 223 may be larger than a thickness of the heater accommodator 221 to further protrude at a front end of the steam generator 223 from a front surface of the heater accommodator 221; however, embodiments are not limited thereto. In addition, the steam generator 223 may be designed in the form of a cylinder having a same inner diameter or a truncated cone type cylinder that increases from a bottom thereof to a top thereof in inner diameter.

An upper end of the steam generator 223 may extend from an upper surface of the heater accommodator 221 (or the case 22) by a preset or predetermined length. An upper portion of the steam generator 223 that protrudes from the upper surface of the heater accommodator 221 may be defined as a discharge port 225.

The steam supply flow path 25 may include an upward portion 251 inserted onto an outer circumferential surface of the discharge port 225 and that extends upwardly, an extension portion 252 that extends by bent from an upper end of the upward portion 251, a downward portion 253 that is bent at an end of the extension portion 252 and extends downward, and a cavity connector 254 that extends from a point on the downward portion 253. The extension portion 252 may extend horizontally.

The cavity connector 254 may have a diameter which is smaller than a diameter of the downward portion 253 and may be bent in an approximately S-shape. The cavity connector 254 may extend horizontally from a point on the downward portion 253 and then be bent to extend upward, and then bent again to extend horizontally. An end of the cavity connector 254 passes through a rear surface of the cavity 11 and communicates with an inside of the cavity 11. Steam flowing along the steam supply flow path 25 is supplied into the cavity 11 through the cavity connector 253.

As the cylinder-shaped steam generator 223 has a small volume, when the water supplied to the steam generator 223 is heated, boiling occurs violently, and in particular, when bumping occurs, high-temperature water overflows to an outside of the steam generator 223 along with steam. In this case, it is necessary to appropriately design the shape of the steam supply flow path 25 to prevent inflow of the boiling water into the cavity 11. The steam supply flow path 25 may be designed to bend in an n-shape to prevent the flow of the boiling and overflowing water into the cavity 11 and to fall by gravity. In addition, the cavity connector 254 is branched from one side of the downward portion 253 and extends upward to supply only gas among liquid and gas in the steam supply flow path 25 into the cavity 11.

The condensed water generated in the steam supply process needs to be recovered into the steam generator 223 without flowing into the cavity 11. For this recovery, a condensed water storage portion 26 may be disposed at an end of the downward portion 253. A condensed water storage space is formed inside of the condensed water storage portion 26 and the recovery flow path 134 extends from a lower surface of the condensed water storage portion 26. The end of the recovery flow path 134 is connected to the common flow path 136 that connects the pump module 30 to the water supply inlet 224 to resupply the condensed water discharged along the recovery flow path 134 to the steam generator 223 of the steam supply portion 21 together with the water supplied along the common flow path 135.

An n-shaped flow path that connects the steam supply portion 21 and a housing 27 may be defined as "a first flow path" and the cavity connector 254 branched from the first flow path may be defined as "a second flow path".

Hereinafter, a cross-sectional structure and an internal structure of each of the steam supply portion 21 and the condensed water storage portion 26 are described with reference to the drawings.

Figure 6:
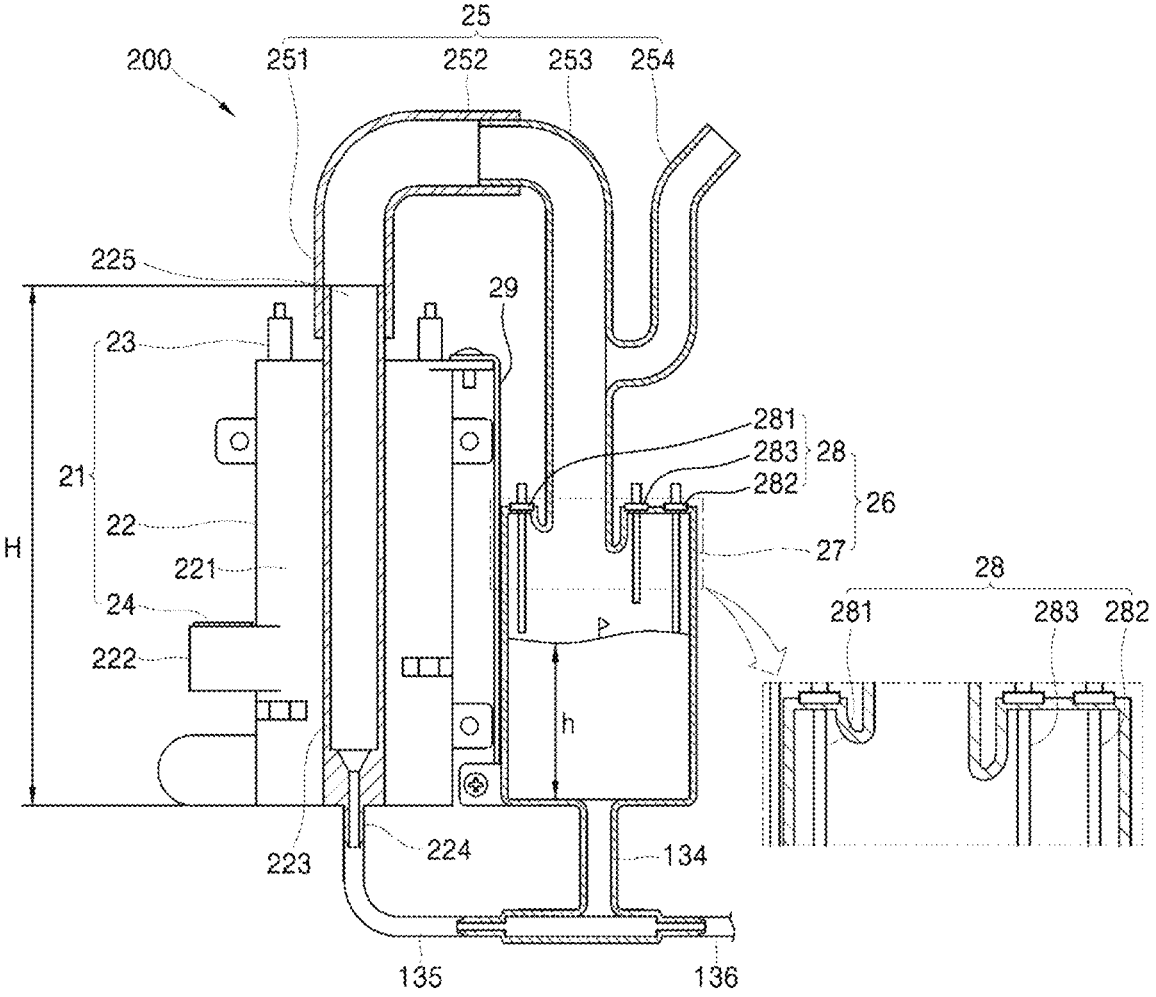
FIG. 6 is a longitudinal cross-sectional view showing a cut-away state of the steam supply device of FIG. 5.

FIG. 6 is a cut-away, cross-longitudinal sectional view showing the steam supply device in FIG. 5. Referring to FIG. 6, a water level sensing module 28 is accommodated in housing 27 of condensed water storage portion 26 to measure a water level inside of the housing 27. In addition, an inner space of the housing 27 communicates with an inner space of the steam generator 223 through common flow path 135 and recovery flow path 134. In this case, the water level inside of the housing 27 may be considered as the water level inside of the steam generator 223. Accordingly, there is no need to provide a water level sensor inside of the steam generator 223, and the water level of the steam generator 223 may be checked by sensing the water level of the condensed water storage portion 26.

The water level sensing module 28 includes a plurality of electrode-type water level sensors. The electrode-type water level sensor has an advantage of superior heat resistance, that is, high-temperature resistance compared to other types of water level sensors, such as a capacitive sensor.

In addition, the water level sensing module 28 may be inserted into the housing 27 in a vertical direction through an upper surface of the housing 27 and may extend downward. If the water level sensing module 28 is inserted into a side surface of the housing 27 in a horizontal direction, water supplied to the steam generator 223 may leak through a through-hole through which the water level sensing module 28 passes. For this reason, the water level sensing module 28 is inserted through the upper surface of the housing 27 to prevent a water leakage problem. In addition, as the electrode-type water level sensor is superior to the capacitive sensor in high-temperature heat resistance, the electrode-type water level sensor has an advantage in a situation in which the electrode-type water level sensor is exposed to high-temperature water vapor.

The water level sensing module 28 includes a common electrode 281, an electrode-type low water level sensor 282, and an electrode-type high water level sensor 282. A lower end of the common electrode 281 is disposed at a same height as a lower end of the low water level sensor 282 or extends to a position closer to a bottom of the housing 27. In addition, a lower end of the high water level sensor 283 is located at a point higher than the lower end of the low water level sensor 282. When water is filled in the housing 27 and a water level (h) reaches the lower end of the high water level sensor 282, the water level thereof is sensed as a high water level. In addition, when the water level (h) reaches the low water level sensor 282 disposed lower than the high water level sensor 283, a current flows between the low water level sensor 282 and the common electrode 281 to detect a water level thereof as a low water level. The lower ends of the electrodes 281, 282, and 283 are coated with Teflon to minimize malfunction.

In addition, when the common electrode 281 and the low water level sensor 282 and the high water level sensor 283 corresponding to operating electrodes are disposed at one side with respect to the downward portion 253, a possibility of occurrence of malfunction and noise is increased due to flowing water. To minimize the occurrence of such a problem, the possibility and frequency of the occurrence of the noise due to the electrode malfunction may be minimized by separating the mounting positions of the common electrode 281 and the operation electrodes from each other with respect to the downward portion 253.

The possibility of generating the noise due to water flowing along the downward portion 253, and subsequently flowing along the common electrode 281 and the operation electrodes is reduced by disposing the common electrode 281 and the operation electrodes at opposite sides. That is, the common electrode 281 may be disposed at a left (first lateral) side of the downward portion 253 and the operation electrodes may be disposed at a right (second lateral) side of the downward portion 253. In addition, as use frequency of the low water level sensor 282 is higher than that of the high water level sensor 283, the lower water level sensor 282 is disposed at an outside of the high water level sensor 283 and is disposed at a farthest position from the downward portion 253 to prevent malfunction.

In addition, a prevention portion may be disposed on an upper surface of the housing 27 between the downward portion 253 and the electrodes to minimize a phenomenon in which discharged water and the condensed water flow along the electrodes 281, 282, and 283. The prevention portion may be depressed from the upper surface of the housing 27 by a predetermined depth. In other words, the preventing portion may be defined as a recess when viewed from outside of the housing 27 and may be defined as a protrusion or a protruding portion when viewed from an inside of the housing 27.

Under a condition in which a temperature of the steam supply portion 21 including case 22 accommodating the U-shaped sheath steam heater 23 and including the cylindrical steam generator at a central portion thereof is maintained at 180° C., optimal steam generation efficiency may be achieved when the water level (h) of the steam supply portion 21 is maintained at 25% of a height (H) of the steam generator 223. When the steam generator 223 inside of the steam supply portion 21 is maintained at a low water level, a temperature of the steam generator 223 continuously increases and the steam heater 23 is turned off to prevent overheating thereof. As a result, a steam generation time is shortened, resulting in a problem in that steam generation efficiency is deteriorated. In contrast, when the inside of the steam generator 223 is maintained at a high water level, the temperature of the steam generator 223 is lower than an appropriate temperature, thereby requiring a longer time to generate the steam and causing bumping in which the steam and water are discharged together toward an outlet of the steam generator 223.

Figure 7:
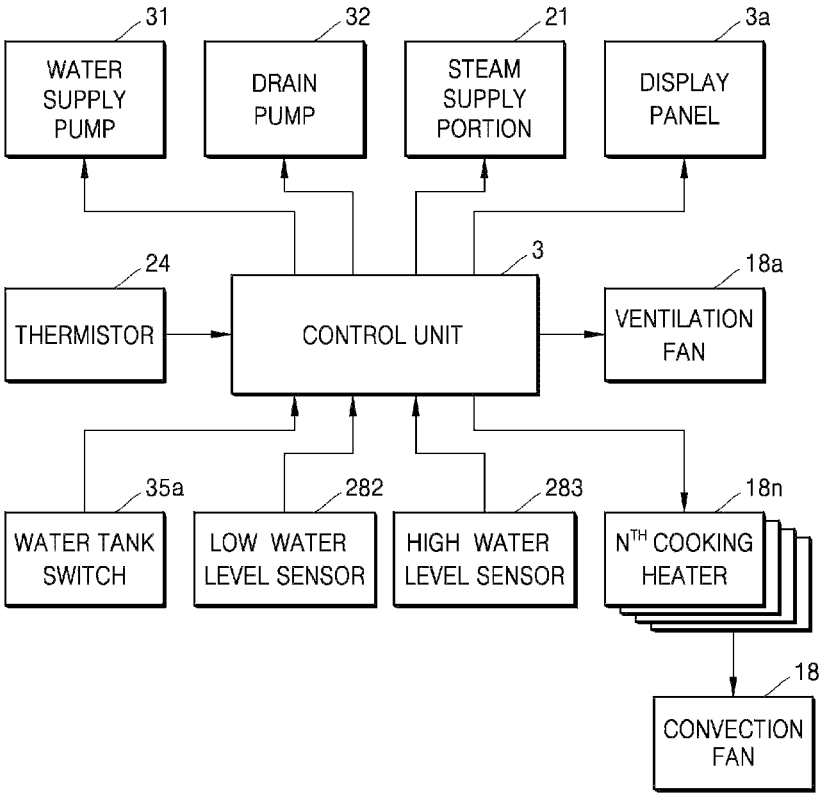
FIG. 7 is a block diagram showing an electrical connection relationship between the control unit in FIG. 1 and components of the electronic cooking apparatus in FIGS. 2 to 6.

FIG. 7 is a block diagram showing an electrical connection relationship between the control unit in FIG. 1 and components of the electronic cooking apparatus in FIGS. 2 to 6. Referring to FIG. 7, control unit 3 controls water level sensing module 28 using low water level sensor 282 and high water level sensor 283 to detect a water level of steam generator 223 and controls water tank switch 35*a* to detect whether water tank 35 is mounted. The control unit 3 may control on/off operations of water supply pump 31 or drain pump 32 based on changes in water level of the steam generator 223 detected by the water level sensing module 28.

In addition, the control unit 3 may indicate the water level state of the steam generator 233 and the mounted state or the removed state of the water tank 35 on a display panel 3*a* or through an alarm generating speaker.

The control unit 3 may control the steam generation operation of the steam supply portion 21 according to user control command input to a plurality of operation switches. In this case, the control unit 3 controls the thermistor 24 of the steam supply portion 21 to detect a steam generating temperature and stably controls the steam generation operation of the steam supply portion 21 to block overheating of the steam supply portion 21. In addition, the control unit 3 controls the on/off operations of the at least one cooking heater 18*n* and the convection fan 18 according to a user's control command input to a plurality of operation switches to heat cooking portion 15.

Hereinafter, descriptions of the control unit 3 to generally control the operation of the electronic cooking apparatus including the steam supply device 200, a plurality of cooking heaters 18*n*, and the convection fan 18 are described.

The control unit 3 controls the low water level sensor 282 and the high water level sensor 283 of the water level sensing module 28 to detect the water level of the steam supply portion 21 in real time. In fact, the low water level sensor 282 and the high water level sensor 283 detect the water level of the condensed water storage portion 26, but as described above, the condensed water storage portion 26 and the steam generator 223 are disposed at a same height and have a same water level.

The control unit 3 controls on/off operations of the water supply pump 31 or the drain pump 32 based on changes in water level of the steam generator 233 detected in real time by the water level sensing module 28. More specifically, when the inside of the steam supply portion 21 is maintained at a low water level for a long period of time, the temperature of the steam generator 223 continuously increases and the steam heater 23 is turned off to prevent overheating thereof. When the water level of the inside of the steam generator 223 is maintained at the low water level for the preset or predetermined period of time or more, the control unit 3 drives (turns on) the water supply pump 31 for the preset period of time. In this case, the drive period of time of the water supply pump 31 may be set in advance to several seconds, and several minutes, several hours, for example, according to performance of the water supply pump 31. Alternatively, the control unit 3 may drive (turn-on) the water supply pump 31 until a high water level is detected by the high water level sensor 283.

When the water level inside of the steam generator 223 is maintained at the high water level, the steam generation time is lengthened and bumping may occur. In this case, the control unit 3 drives (turns on) the drain pump 32 for a preset or predetermined period of time. Likewise, the drive period of time of the drain pump 32 may be preset or predetermined in advance to several seconds, several minutes, and several hours, for example, according to the performance of the drain pump 32. Alternatively, the control unit 3 may drive (turn-on) the drain pump 32 until the high water level is not detected by the high water level sensor 283.

In addition, the control unit 3 controls the on/off operations of the at least one cooking heater 18*n* and the convection fan 18 according to user's control command input to a plurality of operation switches to heat the cooking portion 15.

Figure 8:
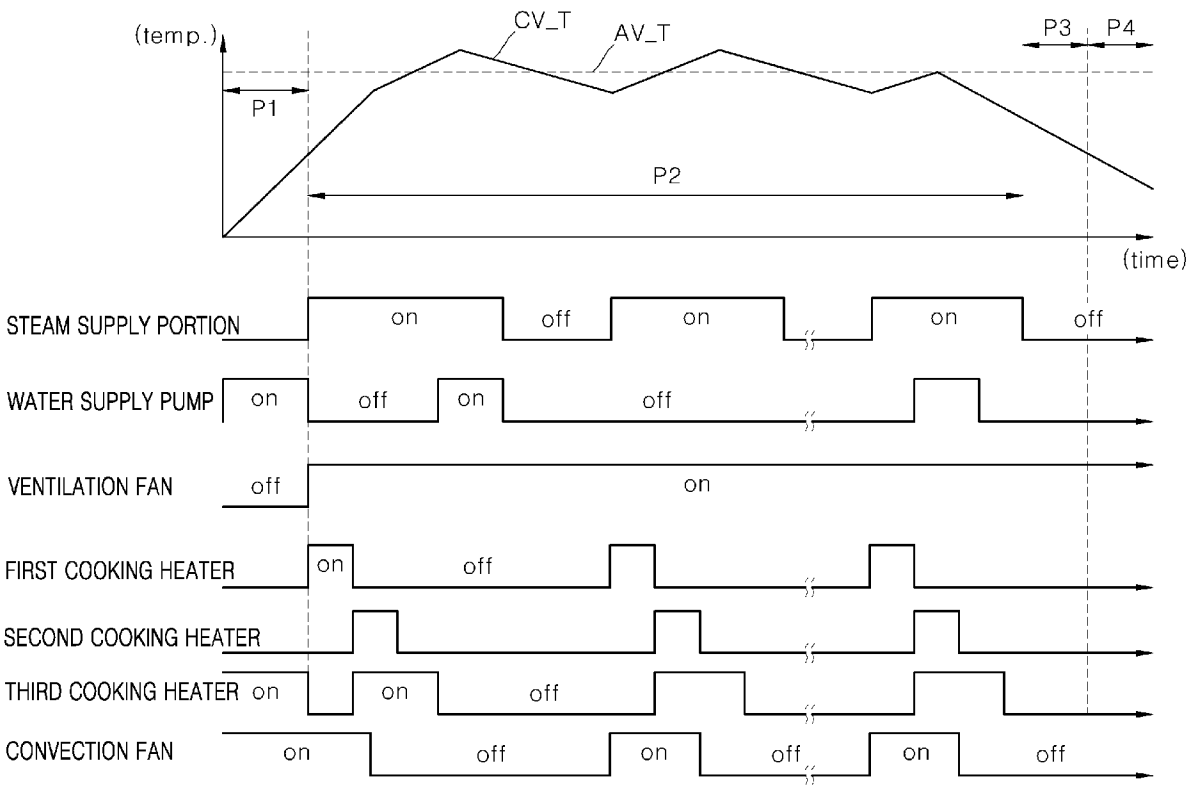
FIG. 8 is a timing diagram showing a steam supply and oven cooking control process by the control unit in FIG. 7.

FIG. 8 is a timing diagram showing a steam supply and oven cooking control process by the control unit in FIG. 7. Referring to FIG. 8, the control unit 3 controls on/off operations of at least one cooking heater 18*n* and convection fan 18 together with steam supply portion 21 according to a user's control command input to an operation switch.

The user may set a cooking period of time and a cooking type as an option using an operation switch of the control unit 3 according to types and materials of food to be cooked. The control unit 3 reads the control command according to the user-set option from a memory and sequentially drives steam supply portion 21, the at least one cooking heater 18*n*, the convection fan 18, and the ventilation fan (a), for example, according to the control command.

For example, a cooking period of time according to the control command may be divided into a preheating period of time (P1) during which a temperature of a cooking portion 15 is preheated, a heating period of time (P2) during which food items are cooked, an exhaust period of time (P3) during which a temperature of the cooking portion 15 is lowered, and a cooking period of time (P4) during which a drain operation is performed.

For the preheating period of time (P1), the control unit 3 drives the water supply pump 31 or the drain pump 32 to adjust the water level of the steam supply portion 21 to a preset or predetermined water level based on a result of detecting the water level of the steam supply portion 21 by the low water level sensor 282 and the high water level sensor 283. For example, the control unit 3 may drive the water supply pump 31 or the drain pump 32 to maintain the water level (h) of the steam generator 223 to be 25% of a height (H) of the steam supply portion 21 under a condition in which the temperature of the steam supply portion 21 is maintained at 180° C. For this, the low water level sensor 282 may be disposed at a height up to 25% of the height (H) of the steam supply portion 21.

In addition, for the preheating period of time (P1), the control unit 3 may selectively drive at least one of the plurality of cooking heaters 18*n* and the convection fan 18 to heat the cooking portion 15. Subsequently, for the heating period of time (P2) during which food items are cooked, the control unit 3 drives the steam supply portion 21 according to the control command in units of preset or predetermined time periods to supply steam into the cooking portion 15. In this case, the control unit 3 may drive the water supply pump 31 or the drain pump 32 to maintain the water level (h) of the steam supply portion 21 at 25% of the height (H) of the steam supply portion 21 even during the heating period of time (P2).

In addition, for the heating period of time (P2) during which food items are cooked, the control unit 3 selectively drives at least one of the plurality of cooking heaters 18*n* and the convection fan 18 to heat the cooking portion 15. In this case, the control unit 3 may selectively drive the at least one cooking heater and the convection fan 18 to maintain an internal temperature (CV_T) of the cooking portion 15 to be equal to a reference temperature (AV_T) according to the control command.

For the preheating period of time (P1) and the heating period of time (P2) during which the food items are cooked, the control unit 3 controls the thermistor 23 of the steam supply portion 21 to detect an internal temperature of the steam supply portion 21. In addition, the control unit 3 may stop the steam generating operation of the steam generator 223 if the temperature sensed by the thermistor 23 is equal to or greater than a preset or predetermined temperature.

For the exhaust period of time (P3) after the food items are cooked according to the control command, the control unit 3 stops operations of the steam supply portion 21, the plurality of cooking heaters 18*n*, and the convection fan 18 except for ventilation fan 18*a* to ventilate cooking portion 15. Subsequently, during the cooking end period of time (P4), the control unit 3 may drive drain pump 32 to perform a drain operation.

Figure 9:
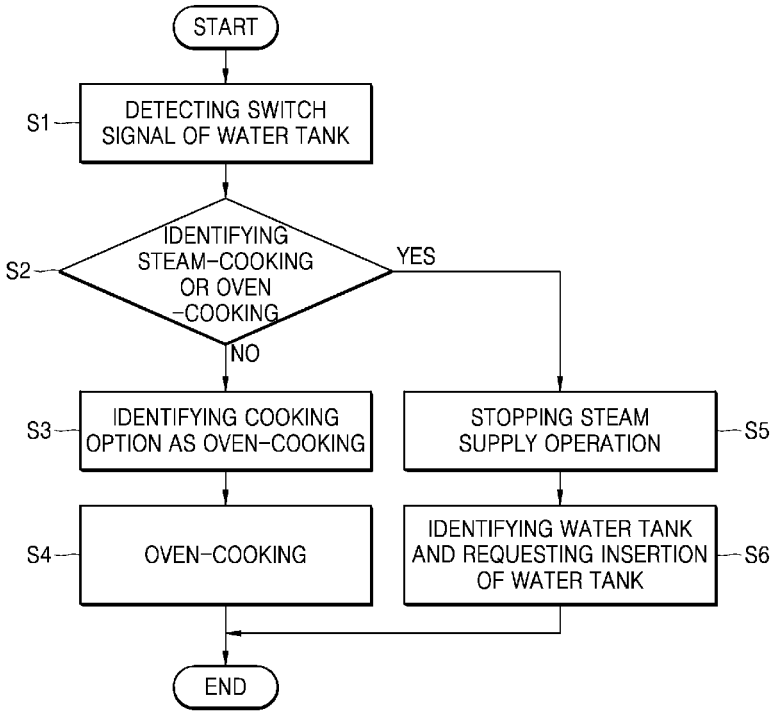
FIG. 9 is a flowchart of a method for controlling, by a control unit, a cooking process according to a mounted state or a non-mounted state of a water tank in FIG. 7.

FIG. 9 is a flowchart of a method for controlling, by control unit, a cooking process according to mounting or removal of the water tank in FIG. 7. As shown in FIG. 9, control unit 3 may indicate a water level state of steam supply portion 21 and a mounted state or removed state of water tank 35 on display panel 3*a* or through an alarm generating speaker.

More specifically, the control unit 3 detects a switch signal of the water tank 35 during a preparation period of time during which a user sets a cooking option and a preheating period of time (P1) during which food items are cooked. In addition, the control unit 3 may indicate the mounted state or the removed state of the water tank 35 on the display panel 3*a* or through the alarm generating speaker (51).

However, even when the water tank 35 is removed, the control unit 3 checks whether a steam-cooking option is set or food items are steam-cooked, and based on the steam-cooking being not set and only the oven-cooking being set, the control unit 3 controls an oven operation to be performed (S2). More specifically, based on the oven-cooking option only being set when the water tank 35 is removed (S3), the control unit 3 stops operation of the steam supply portion 21. In addition, the control unit 3 operates at least one cooking heater 18*n*, convection fan 18, and ventilation fan 18*a* to oven-cook food items (S4).

Based on the steam-cooking option being set when the water tank 35 is removed, the control unit 3 stops the operation of the steam supply portion 21 after indicating the removed state of the water tank 35 on the display panel 3*a* or through the alarm generating speaker. In addition, the control unit 3 indicates the removed state of the water tank 35 on the display panel 3*a* or through the alarm generating speaker until the water tank 35 is mounted (S6).

Figure 10:
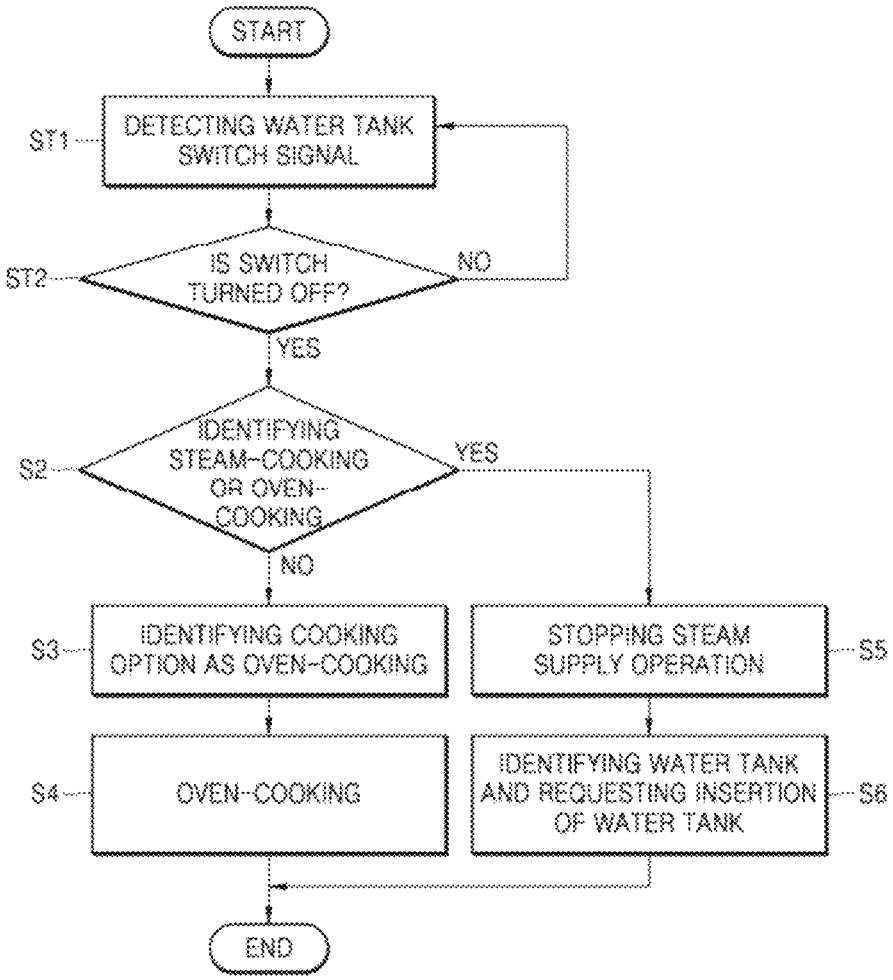
FIG. 10 is a flowchart of a method for controlling, by a control unit, a cooking process according to a removed state or a non-removed state of the water tank in FIG. 7.

FIG. 10 is a flowchart of a method for controlling, by a control unit, a cooking process according to a removed state or a non-removed state of a water tank in FIG. 7. Control unit 3 detects the mounted state or the removed state of water tank 35 in real time during a preheating period of time (P1) during which cooking starts and a heating period of time (P2) which is a cooking period of time to prevent malfunction or failure even if the water tank 35 is removed during the time period for which food items are cooked.

More specifically, control unit 3 detects switch signals of the water tank 35 in real time during the preheating period of time (P1) during which cooking starts and the heating period of time (P2) which is the cooking period of time (ST1 and ST2). In addition, the control unit 3 may indicate the mounted state or the removed state of the water tank 35 on the display panel 3*a* or through the alarm generating speaker.

When the water tank 35 is removed during the cooking period of time, the control unit 3 identifies a current cooking state to check steam-cooking or oven-cooking of the food items (S4). Based on the steam-cooking being not set and only the oven-cooking being set, the control unit 3 operates at least one cooking heater 18*n*, convection fan 18, and ventilation fan 18*a* to oven-cook the food items (S4).

When the water tank 35 is removed while food items are steam-cooked, the control unit 3 indicates the removed state of the water tank 35 on the display panel 3*a* or through an alarm generating speaker, for example, and stops all of the cooking operations including the operation of the steam supply portion 21 (S5). Subsequently, the control unit 3 indicates the removed state of the water tank 35 on the display panel 3*a* or through the alarm generating speaker until the water tank 35 is mounted (S6).

Figure 11:
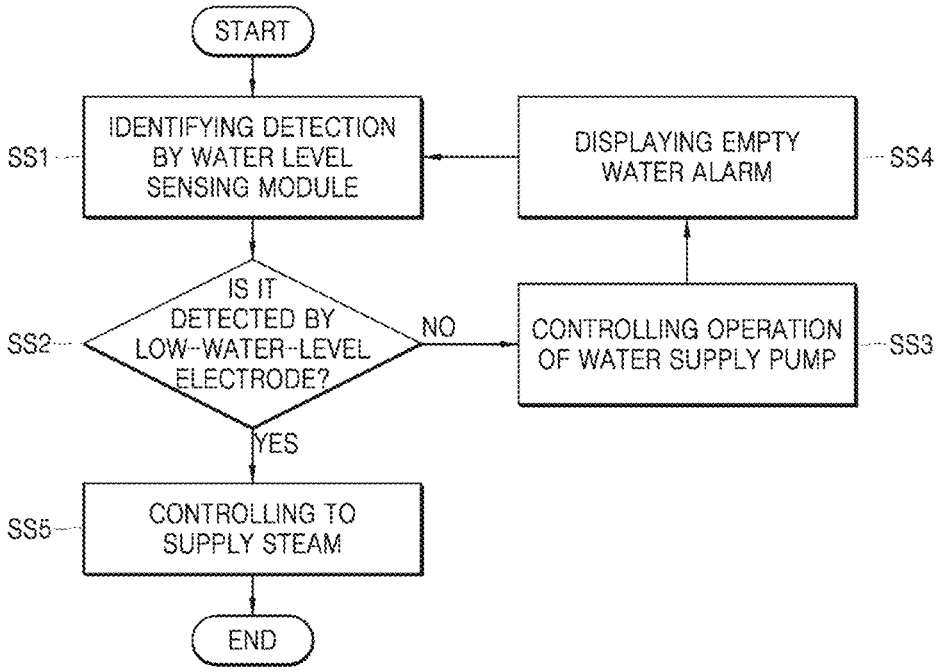
FIG. 11 is a flowchart of a method for controlling, by a control unit, a cooking process according to a result of detecting a water level by low water level and high water level detection sensors in FIG. 7.

FIG. 11 is a flowchart of a method for controlling, by a control unit, a cooking process according to a result of detecting a water level by a low water level sensor and a high water level sensor in FIG. 7. Referring to FIG. 11, control unit 3 may indicate a water level state of steam supply portion 21 in real time on display panel 3*a* or through an alarm generating speaker. More specifically, the control unit 3 detects a water level of the steam supply portion 21 during a preparation period of time during which a user sets a cooking option and a preheating period of time (P1) during which cooking starts (SS1).

The control unit 3 may determine that there is no or very little water based on the water level being not detected by the low water level sensor 282 (SS2). Subsequently, the control unit 3 operates water supply pump 31 for a preset or predetermined period of time to adjust the water level of the steam supply portion 21 to a preset or predetermined water level according to a result of detecting a water level by the low water level sensor 282 (SS3).

For example, based on the water level being not detected by the low water level sensor 282, the control unit 3 may operate the water supply pump 31 for a period of 30 seconds or 1 minute to reach the water level of the steam supply portion 21 or may operate the water supply pump 31 until the water level is detected by the low water level sensor 282 (SS3).

The control unit 3 indicates water level state information of the steam supply portion 21 on the display panel 3*a* or through the alarm generating speaker in real time. In addition, based on the water level being detected by the low water level sensor 282, the control unit 3 may control the steam supply portion 21 to generate the steam (SS5).

Figure 12:
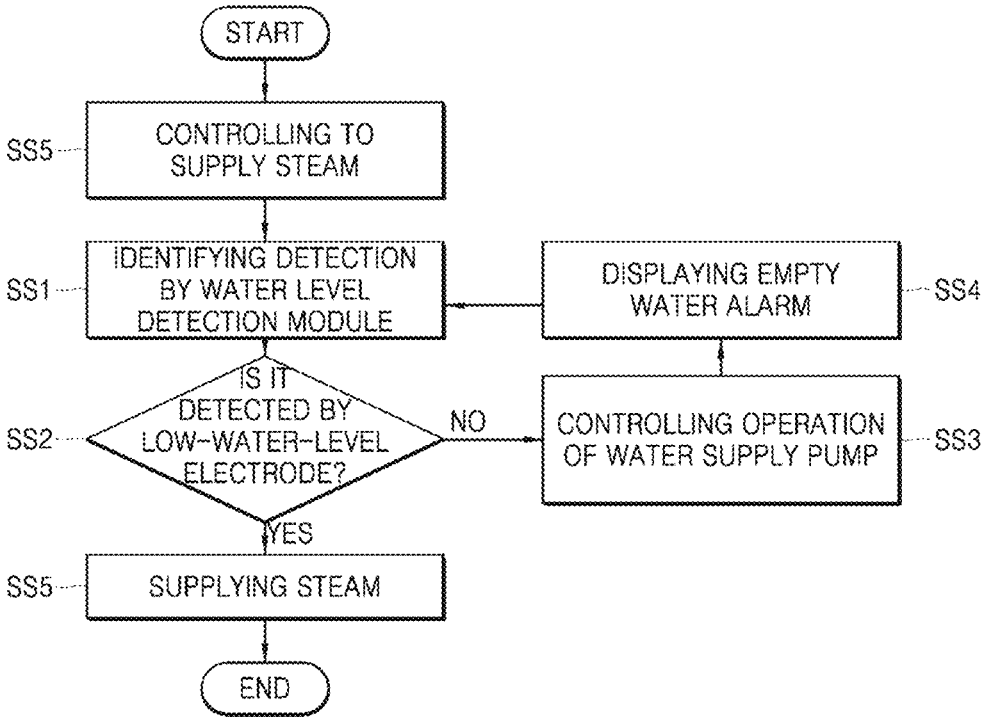
FIG. 12 is a flowchart of a method for controlling, by a control unit, a cooking process according to changes in water level detected by a low water level detection sensor and a high water level detection sensor in FIG. 7.

FIG. 12 is a flowchart of a method for controlling, by a control unit, a cooking process according to changes in water level detected by a low water level sensor and a high water level sensor in FIG. 7. Referring to FIG. 12, control unit 3 may indicate a water level state of steam supply portion 21 in real time on display panel 3*a* or through an alarm generating speaker.

More specifically, the control unit 3 identifies the water level state of the steam supply portion 21 during a preheating period of time (P1) during which cooking starts and a heating period of time (P2) which is a cooking period of time (SS1).

The control unit 3 may determine that there is no or very little water based on the water level being not detected by a low water level sensor 282 (SS2). Subsequently, the control unit 3 operates a water supply pump 31 for a preset or predetermined period of time to adjust the water level of the steam supply portion 21 to a preset or predetermined water level based on a result of detecting the water level by the low water level sensor 282 (SS3). For example, the control unit 3 may operate the water supply pump 31 until the water level is detected by the low water level sensor 282.

In this case, the control unit 3 indicates the water level state information of the steam supply portion 21 on the display panel 3*a* or through the alarm generating speaker in real time (SS4). In addition, based on the water level being detected by the low water level sensor 282, the control unit 3 may control the steam supply portion 21 to generate the steam (SS5).

As described above, the electronic cooking apparatus including the steam supply device 200 according to the embodiment improves the water level detection function of the steam supply device 200, thereby maximizing steam generation efficiency and cooking efficiency. In particular, the electrode-type high water level sensor 283 and low water level sensor 282 having the high-temperature resistance are disposed in the condensed water storage portion 26 of the steam supply device 200 to detect the quantity needed to generate the steam in real time.

In addition, water from the water tank may be supplied to the steam generator 21 by controlling the water supply pump 31 in real time to satisfy the quantity needed to generate the steam. In addition, the control unit 3 may notify the water level state of the steam generator 21 and the water recovery portion, and the mounted state or the removed state of the water tank 35 to the outside through the display panel or by the sound alarm. Therefore, there is an effect of improving user satisfaction and user reliability for the electronic cooking apparatus including the steam supply device 200.

Various substitutions, changes, and modifications may be made by a person having ordinary knowledge in the art to which embodiments pertain within the scope that does not deviate from the technical idea. That is, embodiments are not limited to the above-described embodiments and accompanying drawings.

What is claimed is:

1. An electronic cooking apparatus comprising a steam supply device, comprising:

the steam supply device comprising a steam supply portion including a case and a steam heater and configured to generate steam and supply the steam to a cooking chamber and a water level sensing module comprising a common electrode, a low water level sensor, and a high water level sensor and configured to detect a water level at an inside of the steam supply portion using the common electrode, the low water level sensor, and the high water level sensor;

a water supply pump configured to supply water from a water tank to the steam supply portion;

a drain pump configured to recover condensed water from the steam supply portion to the water tank; and a controller configured to control on/off operations of the water supply pump or the drain pump according to changes in water level in the steam supply portion detected by the water level sensing module, wherein the steam supply device further comprises:

a first flow path including an upward portion extending upward from the steam supply portion, an extension portion extending in a lateral direction from the upward portion, and a downward portion extending downward from the extension portion to an inside of a condensed water storage portion;

a second flow path branched from the downward portion and extending to the cooking chamber, wherein an end of the downward portion extends into the inside of the condensed water storage portion to recover and store the condensed water from the steam supply portion;

a water supply flow path configured to supply the water from the water supply pump to the steam supply portion; and a recovery flow path that connects the condensed water storage portion to the water supply flow path, and wherein the common electrode is disposed to extend downward from a first lateral upper surface of the condensed water storage portion, with respect to the downward portion, and operation electrodes, corresponding to the low water level sensor and the high water level sensor, are disposed to extend downward from a second lateral upper surface opposite to the first lateral upper surface, such that the common electrode and the operation electrodes are spatially separated with the downward portion positioned therebetween, thereby reducing a likelihood of malfunction and noise caused by water flow and electrode interference.

2. The electronic cooking apparatus of claim 1, wherein the low water level sensor and the high water level sensor face inward from a top of the condensed water storage portion together with the common electrode and are configured to detect a water level inside of the condensed water storage portion in real time, and wherein the controller is configured to identify the water level inside of the condensed water storage portion as a same water level as the water level inside of the steam supply portion.

3. The electronic cooking apparatus of claim 2, wherein the top of the condensed water storage portion comprises a recess that extends downwards from the top of the condensed water storage portion between the first flow path and the common electrode and between the first flow path and the high water level sensor.

4. The electronic cooking apparatus of claim 1, wherein the controller is configured to:

if the water level inside of the steam supply portion detected by the low water level sensor is maintained at a low water level for a predetermined period of time, drive the water supply pump for the predetermined period of time or until a high water level is detected by the high water level sensor; and if the water level inside of the steam supply portion detected by the high water level sensor is maintained at the high water level for the predetermined period of time, drive the drain pump for the predetermined period of time or until the high water level is not detected by the high water level sensor.

5. The electronic cooking apparatus of claim 1, wherein the controller is configured to:

control the low water level sensor and the high water level sensor to detect the water level of the steam supply portion from a preheating period of time during which cooking starts to an exhaust period of time during which cooking ends; and drive the water supply pump or the drain pump based on a result of detecting the water level of the steam supply portion to adjust the water level of the steam supply portion to a predetermined water level.

6. The electronic cooking apparatus of claim 1, wherein the controller is configured to, during a preheating period of time and a heating period of time during which food items are cooked:

selectively drive at least one of a plurality of cooking heaters or a convection fan according to a user-set control command to heat the cooking chamber; and drive the steam supply portion in units of a predetermined period of time to supply the steam to an inside of the cooking chamber.

7. The electronic cooking apparatus of claim 6, wherein the controller is configured to:

ventilate the inside of the cooking chamber by stopping operations of the steam supply portion, the plurality of cooking heaters, and the convection fan except for a ventilation fan during an exhaust period of time after food items are cooked according to a control command, and drive the drain pump to perform a drain operation for a cooking end period of time.

8. The electronic cooking apparatus of claim 6, wherein the controller is configured to:

control a thermistor of the steam supply portion to detect an internal temperature of the steam supply portion during the preheating period of time and the heating period of time during which food items are cooked and based on a temperature detected by the thermistor being equal to or higher than a predetermined temperature, stop a steam generating operation of the steam supply portion.

9. The electronic cooking apparatus of claim 1, wherein the controller is configured to:

detect a switch signal of the water tank during a preparation period of time during which a user sets a cooking option and a preheating period of time during which cooking starts and indicate a mounted state or a removed state of the water tank on a display panel or through an alarm generating speaker; and if a steam cooking is not set and oven cooking is only set even when the water tank is removed, stop operation of the steam supply portion and operate at least one cooking heater, a convection fan, or a ventilation fan to oven-cook food items.

10. The electronic cooking apparatus of claim 1, wherein the controller is configured to:

detect a switch signal of the water tank in real time during a pre-heating period of time during which cooking starts and a heating period of time, which is a cooking period of time, and display a mounted state or a removed state of the water tank on a display panel or through an alarm generating speaker;

determine whether food items are to be steam-cooked or oven-cooked when the water tank is removed during the pre-heating period of time and the heating period of time;

based on the determination that the food items are only to be oven-cooked, operate at least one of a cooking heater, a convection fan, or a ventilation fan to oven-cook the food items; and based on the determination that the food items are to be steam-cooked, stop a cooking operation thereof and indicate a removed state of the water tank on the display panel or through the alarm generating speaker until the water tank is mounted.

11. The electronic cooking apparatus of claim 1, wherein the controller is configured to:

detect a water level state of the steam supply portion in real time during a preparation period of time during which a user sets a cooking option, a preheating period of time during which cooking starts, and a heating period of time during which food items are cooked;

based on the water level being not detected by the low water level sensor, operate the water supply pump for a predetermined period of time to adjust the water level of the steam supply portion to a predetermined water level; and indicate water level state information of the steam supply portion in real time on a display panel or through an alarm generating speaker.

12. An electronic cooking apparatus, comprising:

a main body;

a cooking chamber provided in the main body;

a steam generator configured to generate steam and supply the steam to the cooking chamber, the steam generator comprising a steam supply chamber, a steam heater, a steam supply flow path, and at least one water level sensor configured to detect a water level inside of the steam supply chamber;

a water supply pump configured to supply water from a water tank to the steam supply chamber;

a drain pump configured to recover condensed water from the steam supply flow path to the water tank; and a controller configured to control on/off operations of the water supply pump or the drain pump according to changes in water level in the steam supply chamber detected by the at least one water level sensor, wherein the at least one water level sensor comprises:

a common electrode;

a low water level sensor configured to detect a low level of water in the steam supply chamber; and a high water level sensor configured to detect a high level of water in the steam supply chamber, wherein the steam supply flow path extends from the steam supply chamber to the cooking chamber, wherein the steam supply flow path comprises:

a first flow path including an upward portion extending upward from the steam supply chamber, an extension portion extending in a lateral direction from the upward portion, and a downward portion extending downward from the extension portion to an inside of a condensed water storage chamber; and a second flow path branched from the downward portion and extending to the cooking chamber, wherein the steam generator further comprises:

the condensed water storage chamber, wherein an end of the downward portion of the steam supply flow path extends into the inside of the condensed water storage chamber to recover and store the condensed water from the steam supply flow path;

a water supply flow path configured to supply the water from the water supply pump to the steam supply chamber; and a recovery flow path that connects the condensed water storage chamber to the water supply flow path, and wherein the common electrode is disposed to extend downward from a first lateral upper surface of the condensed water storage chamber, with respect to the downward portion, and operation electrodes, corresponding to the low water level sensor and the high water level sensor, are disposed to extend downward from a second lateral upper surface opposite to the first lateral upper surface, such that the common electrode and the operation electrodes are spatially separated with the downward portion positioned therebetween, thereby reducing a likelihood of malfunction and noise caused by water flow and electrode interference.

13. The electronic cooking apparatus of claim 12, wherein the low water level sensor and the high water level sensor are electrode-type water level sensors.

14. The electronic cooking apparatus of claim 12, wherein the low water level sensor and the high water level sensor face inward from a top of the condensed water storage chamber together with the common electrode and are configured to detect a water level inside of the condensed water storage chamber in real time, and wherein the controller is configured to identify the water level inside of the condensed water storage chamber as a same water level as the water level inside of the steam supply chamber.

15. The electronic cooking apparatus of claim 14, wherein the top of the condensed water storage portion comprises a recess that extends downwards from the top of the condensed water storage portion between the steam supply flow path and the common electrode and between the steam supply flow path and the high water level sensor.

16. The electronic cooking apparatus of claim 12, wherein the controller is configured to:

if the water level inside of the steam supply chamber detected by the at least one water level sensor is maintained at a low water level for a predetermined period of time, drive the water supply pump for the predetermined period of time or until a high water level is detected by the at least one water level sensor; and if the water level inside of the steam supply chamber detected by the at least one water level sensor is maintained at the high water level for the predetermined period of time, drive the drain pump for the predetermined period of time or until the high water level is not detected by the at least one water level sensor.

17. The electronic cooking apparatus of claim 12, wherein the controller is configured to:

control the at least one water level sensor to detect the water level of the steam supply chamber from a preheating period of time during which cooking starts to an exhaust period of time during which cooking ends; and drive the water supply pump or the drain pump based on a result of detecting the water level of the steam supply chamber to adjust the water level of the steam supply chamber to a predetermined water level.

18. The electronic cooking apparatus of claim 12, further comprising:

a thermistor, wherein the controller is configured to control the thermistor to detect an internal temperature of the steam supply chamber during a preheating period of time and a heating period of time during which food items are cooked, and based on a temperature detected by the thermistor being equal to or higher than a predetermined temperature, stop a steam generating operation of the steam generator.

19. An electronic cooking apparatus, comprising:

a main body;

a cooking chamber provided in the main body;

a steam generator configured to generate steam and supply the steam to the cooking chamber, the steam generator comprising a water supply flow path, a steam supply chamber, a steam heater, a steam supply flow path, a condensed water storage chamber connected to the steam supply flow path, a recovery flow path that connects the condensed water storage chamber to the water supply flow path, and at least one water level sensor configured to detect a water level inside of the steam supply chamber based on a level of water in the condensed water storage chamber;

a water supply pump configured to supply water from a water tank to the steam supply chamber;

a drain pump configured to recover condensed water from the steam supply flow path to the water tank; and a controller configured to control on/off operations of the water supply pump or the drain pump according to changes in water level in the steam supply chamber detected by the at least one water level sensor, wherein the steam supply flow path comprises:

a first flow path including an upward portion extending upward from the steam supply chamber, an extension portion extending in a lateral direction from the upward portion, and a downward portion extending downward from the extension portion to an inside of the condensed water storage chamber; and a second flow path branched from the downward portion and extending to the cooking chamber, wherein the at least one water level sensor comprises:

a common electrode;

a low water level sensor configured to detect a low level of water in the steam supply chamber; and a high water level sensor configured to detect a high level of water in the steam supply chamber, wherein an end of the downward portion of the steam supply flow path extends into the inside of the condensed water storage chamber to recover and store the condensed water from the steam supply flow path, and wherein the common electrode is disposed to extend downward from a first lateral upper surface of the condensed water storage chamber, with respect to the downward portion, and operation electrodes, corresponding to the low water level sensor and the high water level sensor, are disposed to extend downward from a second lateral upper surface opposite to the first lateral upper surface, such that the common electrode and the operation electrodes are spatially separated with the downward portion positioned therebetween, thereby reducing a likelihood of malfunction and noise caused by water flow and electrode interference.

20. The electronic cooking apparatus of claim 19, wherein the low water level sensor and the high water level sensor face inward from a top of the condensed water storage chamber together with the common electrode and are configured to detect a water level inside of the condensed water storage chamber in real time, and wherein the controller is configured to identify the water level inside of the condensed water storage chamber as a same water level as the water level inside of the steam supply chamber, and wherein the top of the condensed water storage portion comprises a recess that extends downwards from the top of the condensed water storage portion between the steam supply flow path and the common electrode and between the steam supply flow path and the high water level sensor.

* * * * *